US007661241B2

(12) United States Patent
Gosis et al.

(10) Patent No.: US 7,661,241 B2
(45) Date of Patent: Feb. 16, 2010

(54) UNIVERSAL STAIRCASE TOOL

(75) Inventors: Anatoly Gosis, Palatine, IL (US); Richard L. Edwards, Cary, IL (US); Howard W. Kimball, Canal Winchester, OH (US); Anthony Brent Marshall, Killeen, TX (US)

(73) Assignee: Illinois Tool Works Inc., Glenview, IL (US)

( * ) Notice: Subject to any disclaimer, the term of this patent is extended or adjusted under 35 U.S.C. 154(b) by 546 days.

(21) Appl. No.: 11/107,760

(22) Filed: Apr. 18, 2005

(65) Prior Publication Data

US 2006/0230851 A1 Oct. 19, 2006

(51) Int. Cl.
*B23D 7/08* (2006.01)

(52) U.S. Cl. ..... 52/749.1; 52/DIG. 1; 52/182; 269/295; 269/293; 83/745; 83/766

(58) Field of Classification Search ..... 52/749.1, 52/DIG. 1, 182; 269/87.2, 295, 293; 83/398, 83/766, 745, 762
See application file for complete search history.

(56) References Cited

U.S. PATENT DOCUMENTS 3,397,722 A * 8/1968 Long ..... 83/762
3,622,145 A * 11/1971 Gibson ..... 269/297
3,782,235 A * 1/1974 Curcio ..... 83/762
4,300,755 A * 11/1981 Potvin ..... 269/87.2
5,284,331 A * 2/1994 Lee et al. ..... 269/16
5,823,084 A * 10/1998 Ramey ..... 83/415
5,960,843 A * 10/1999 Witt ..... 144/372
6,206,060 B1 * 3/2001 Blake ..... 144/87
6,530,302 B1 * 3/2003 Rogers ..... 83/452
6,662,699 B1 * 12/2003 Schmidt ..... 83/765
6,668,695 B2 * 12/2003 Poole et al. ..... 83/466
6,698,328 B1 * 3/2004 Schmidt ..... 83/766
7,159,498 B2 * 1/2007 Stewart ..... 83/745

* cited by examiner

*Primary Examiner*—Phi Dieu Tran A
(74) *Attorney, Agent, or Firm*—Law Offices of Steven W. Weinrieb

(57) ABSTRACT

A new and improved single tool or jig which is universally useable in connection with the fabrication or trimming of left and right side edge portions of stair tread components, left and right end portions of stair tread side edge plank components, and stair riser components, so as to permit all of such components to be properly mated together in order to impart to the exposed or open stair members a seamless finished appearance.

22 Claims, 8 Drawing Sheets

UNIVERSAL STAIRCASE TOOL

FIELD OF THE INVENTION

The present invention relates generally to fabrication tools, and more particularly to a new and improved single tool or jig which is universally useable in connection with the fabrication or trimming of left and right side edge portions of stair tread components, left and right end portions of stair tread side edge plank components, and stair riser components, so as to permit all of such components to be properly mated together in order to impart to the exposed or open stair members a seamless finished appearance.

BACKGROUND OF THE INVENTION

As is well-known in the staircase art and industry, a typical stair tread member, generally indicated by the reference character 10 in FIG. 1, is formed as an elongated member which conventionally comprises a substrate member 12, which is fabricated from fiberboard or particleboard having a predetermined density value, and a decorative laminate 14 which is secured over the substrate member 12, by means of suitable high-pressure bonding techniques, so as to effectively cover or encapsulate the substrate member 12. The front edge portion of the substrate member 12 comprises a nose portion 16 which is either integrally formed with the substrate member 12 so as to comprise a one-piece structure, or is integrally attached to the substrate member 12 prior to the covering or encapsulation of the substrate member 12 within the decorative laminate 14, while the oppositely disposed side edge portions 18,20 of the stair tread member 10 remain unfinished. In connection with the installation of staircase assemblies within residential or commercial structures, several different types of staircase structures or frameworks will commonly be required, and therefore encountered, in accordance with, or dictated by, the specific architectural layout or arrangement characteristic of, or incorporated within, the particular residential or commercial structure. More particularly, depending upon the particular disposition or location of the staircase assembly within the particular residential or commercial structure, the aforenoted oppositely disposed side edge portions 18,20 of the stair tread member 10 may remain unfinished, or alternatively, the aforenoted oppositely disposed side edge portions 18,20 of the stair tread member 10 need to effectively be covered by means of a suitable stair tread side edge plank member.

For example, oftentimes the staircase assembly is simply interposed between two interior side walls of the residential or commercial structure, whereby the front edge portion of each stair tread member 10 is the only exposed edge portion of the stair tread member 10. Accordingly, the oppositely disposed exposed side edge portions 18,20 of the stair tread member 10 will, in effect, be covered by means of the two interior side wall members of the residential or commercial structure whereby such oppositely disposed exposed side edge portions 18,20 of the stair tread member 10 do not need to be finished, and in addition, since the exposed front edge portion of the stair tread member 10 is already aesthetically finished by means of the integrally fabricated or integrally attached nose member 16 and the overlying laminate 14, no further finishing of the stair tread member 10 needs to be implemented. In accordance with other types of staircase assemblies, however, one or both side edge portions 18, 20 of each stair tread member 10, in addition to the front edge portion of the stair tread member 10, will be respectively exposed, whereby such side edge portions 18,20 of each stair tread member 10 must have stair tread side edge plank members, such as, for example, the stair tread side edge plank member, which is disclosed within FIG. 2 and which is generally indicated by the reference character 22, integrally attached thereto in order to impart an aesthetically finished appearance to such side edge portions 18,20 of each stair tread member 10.

More particularly, as was the case with the stair tread member 10, the stair tread side edge plank member 22 is formed as an elongated member comprising a substrate member 24, which is fabricated from fiberboard or particleboard having a predetermined density value, and a decorative laminate 26. The decorative laminate 26 is adapted to be similar to the decorative laminate 14 covering the stair tread substrate member 12, so as to aesthetically match the same when the stair tread side edge plank member 22 is secured to one of the oppositely disposed side edge portions 18,20 of the stair tread member 10, and is secured over the substrate member 24 by means of suitable high-pressure bonding techniques so as to effectively cover or encapsulate the substrate member 24. As was also the case with the stair tread member 10, the elongated edge portion of the substrate member 24 comprises a nose portion 28 which is either integrally formed with the substrate member 24 so as to comprise a one-piece structure, or is integrally attached to the substrate member 24 prior to the covering or encapsulation of the substrate member 24 within the decorative laminate 26. Continuing further, if, in fact, a stair tread side edge plank member 22 needs to be secured to one or both of the oppositely disposed side edge portions 18,20 of the stair tread member 10, the corner regions of the stair tread member 10 and the stair tread side edge plank member 22 need to be appropriately or suitably cut and trimmed in a mitered fashion, for example, so as to enable or facilitate the coupling together of such structural stair tread and stair tread side edge plank members 10,22 whereby the stair tread side edge plank member 22 can effectively cover, for example, the originally exposed side edge portion 20 of the stair tread member 10 in an aesthetically smooth and seamless manner as disclosed within FIG. 3.

Various tools or jigs have in fact been developed in order to achieve the aforenoted cutting and trimming operations necessary to the proper mating and coupling together of the stair tread and stair tread side edge plank members in an aesthetically smooth and seamless manner, however, such tools or jigs are effectively limited in their capabilities in that they are not able to perform such cutting and trimming operations upon the opposite sides, or upon the opposite ends, of the stair tread and the stair tread side edge plank members so as to in fact enable both oppositely disposed exposed sides of the stair tread member to be appropriately finished in the desired manner. In addition, such PRIOR ART or previously developed tools or jigs have not in fact been able to appropriately cut and trim the riser members of the staircase assemblies when edge portions of the riser members are likewise exposed in accordance with the particular structure characteristic of a particular staircase assembly. For example, as disclosed within FIG. 4, in accordance with one conventional, PRIOR ART tool or jig for cutting and trimming stair tread and stair tread side edge plank members in order to permit or facilitate the integral coupling together of such members or components in an aesthetically smooth and seamless manner, wherein the tool or jig is generally indicated by the reference character 110, a support plate or work table 112 has an upper surface portion, not illustrated, and a lower surface portion 114. The upper surface portion is substantially planar so as to support a suitable cutting device, such as, for example, a router, for performing the cutting or trimming operation, and the lower surface portion 114 is provided with a plurality of clamping mechanisms and positioning devices so as to properly position and secure the stair tread and stair tread side edge plank members when the same are being cut or trimmed.

More particularly, a first pair of stair tread locating pins 116,118 are mounted upon the lower surface portion 114 of the support plate or work table 112 so as to engage the nose portion 16 of the stair tread member 10, and a second pair of universal locating pins 120,122 are also mounted upon the lower surface portion 114 of the support plate or work table 112 so as to engage the right side edge portion 18 of the stair tread member 10. A separate locating pin 124 is also mounted upon the lower surface portion 114 of the support plate or work table 112 so as to engage the edge portion of the stair tread member 10 which is disposed opposite the nose portion 16 of the stair tread member 10, and lastly, an adjustable lateral positioning member 126 is also mounted upon the lower surface portion 114 of the support plate or work table 112 so as to likewise engage the edge portion of the stair tread member 10 which is disposed opposite the nose portion 16 of the stair tread member 10 and thereby effectively force the nose portion 16 of the stair tread member 10 into engagement with the first pair of stair tread locating pins 116,118 as the lateral positioning member 126 is positionally adjusted.

In this manner, when the stair tread member 10 is mounted upon the lower surface portion 114 of the support plate or work table 112 such that the nose portion 16, the right side edge portion 18, and the edge portion of the stair tread member 10 disposed opposite the nose portion 16, are respectively engaged with the first and second pairs of locating pins 116, 118, and 120,122, as well as with the separate locating pin 124, and when the lateral positioning member 126 is also appropriately adjusted, then the stair tread member 10 will be properly positioned upon the tool or jig 110 in connection with a through-slot 128 which is formed within the support plate or work table 112 so as to extend between the upper and lower surface portions of the support plate or work table 112. The through-slot 126 has a substantially "hockey-stick" type configuration comprising a linear or straight section 130, and an angled section 132 which is oriented or directed at a predetermined angle with respect to the linear or straight section 130, whereby the angled section 132 of the through-slot 126 enables or facilitates the cutting of the stair tread member 10 or the stair tread side edge plank member 22 in a mitered fashion such that the stair tread member 10 and stair tread side edge plank member 22 will be provided with complementary mitered interfaces whereby such complementary stair tread and stair tread side edge plank members 10,22 can in fact be coupled together in an aesthetically smooth and seamless manner.

It is noted that when the stair tread side edge plank member 22 is mounted upon the lower surface portion 114 of the support plate or work table 112, the finished edge or nose portion 28 of the stair tread side edge plank member 22 will be disposed in contact with the second pair of universal locating pins 120,122, one end portion of the stair tread side edge plank member 22 will be disposed in contact with the locating pin 116, and the opposite end portion of the stair tread side edge plank member 22 will be disposed in contact with the separate locating pin 124. It is lastly noted that in order to respectively fixedly secure the stair tread member 10 or the stair tread side edge plank member 22 upon the lower surface portion 114 of the support plate or work table 112, a first set of clamping mechanisms 134 are disposed along one longitudinally extending side edge portion of the linear or straight section 130 of the "hockey-stick" slot 128, while a second set of clamping mechanisms 136, arranged in oppositely disposed pairs, are disposed along loci which are effectively perpendicular to the longitudinal extent of the linear or straight section 130 of the "hockey-stick" slot 128. All of the clamping mechanisms 134,136 are utilized to secure the stair tread member 10 onto the lower surface portion 114 of the support plate or work table 112, however, only the first set of clamping mechanisms 134 are utilized to clamp the stair tread side edge plank member 22 onto the lower surface portion 114 of the support plate or work table 112.

While the aforenoted tool or jig 110 has operated satisfactorily, it can be readily appreciated that this tool or jig 110 is effectively limited in its operational capabilities in that it only enables one originally exposed side edge portion of the stair tread member 10, that is, the right side edge portion 18 thereof, to be mated with a right side stair tread side edge plank member 22 because the aforenoted angled orientation of the angled portion 132 of the "hockeystick" type through-slot 128 does not readily permit cutting or trimming operations to be performed in connection with the opposite side edge portion of the stair tread member 10 or in connection with the opposite stair tread edge plank member which would be used to mate with the other exposed edge portion 20 of the stair tread member 10. Accordingly, another tool or jig, similar to the tool or jig 110 but having an oppositely angled or mirror-image through-slot formed therein, must be used if both opposite side edges of the stair tread member 10 needs to be aesthetically finished, but obviously, this does not comprise an efficient resolution to the aforenoted problem from a cost-effective manufacturing point of view.

Another possible alternative to the aforenoted problem, that is, to achieve mitered, or otherwise complementary mated interfaces upon both side edge portions of the stair tread member 10, or upon both opposite ends of the stair tread side edge plank member 22, by means of the same tool or jig, would be to simply invert or turn the stair tread and stair tread side edge plank members 10,22 upside down. In this manner, in lieu of the upper planar laminated surface portions 14,26 of the stair tread and stair tread side edge plank members 10,22 being disposed in contact with the lower surface portion 114 of the support plate or work table 112, the undersurface portions 30,32 of the stair tread and stair tread side edge plank members 10,22 would be disposed in contact with the lower surface portion 114 of the support plate or work table 112, or more particularly, the undersurface portions 30,32 of the stair tread and stair tread side edge plank members 10,22 would be facing or disposed toward the lower surface portion 114 of the support plate or work table 112. It is to be appreciated, however, that the nose portions 16,28 of the stair tread and stair tread edge plank members 10, 22 will actually be disposed in contact with the lower surface portion 114 of the support plate or work table 112 whereby the undersurface portions 30,32 of the stair tread and stair tread side edge plank members 10,22 would actually not be able to be disposed in contact with the lower surface portion 114 of the support plate or work table 112 in a surface-to-surface or flush manner. Accordingly, either the stair tread and stair tread side edge plank members 10,22 would have to, in effect, be repositioned with respect to the lower surface portion 114 of the support plate or work table 112 such that the nose portions 16,28 of the stair tread and stair tread side edge plank members 10,22 would effectively be able to be positionally accommodated, or alternatively, particularly configured spacer members would have to be interposed between the under-surface portions 30,32 of the stair tread and stair tread side edge plank members 10,22 and the lower surface portion 114 of the support plate or work table 112 so as to enable the stair tread and stair tread side edge plank members 10,22 to be disposed upon the lower surface portion 114 of the support plate or work table 112 in a stable manner. Obviously, again, neither one of these proposals is truly viable from an efficient, cost-effective manufacturing point of view.

Still yet further, another possible solution to the aforenoted problem, that is, to achieve mitered, or otherwise complementary mated interfaces upon both side edge portions of the stair tread member 10, or upon both opposite ends of the stair tread side edge plank member 22, by means of the same tool or jig, would be to install clamping mechanisms and other positioning components, similar to those installed upon the lower surface portion 114 of the support plate or work table 112, upon the upper surface portion of the support plate or work table 112. This proposal, however, would likewise not be a viable solution in view of the fact that the provision and disposition of the clamping mechanisms and the other positioning components upon the upper surface portion of the support plate or work table 112 would interfere with the mounting and operation of the router mechanism which is disposed upon The upper surface portion of the support plate or work table 112. Still yet further, the clamping mechanisms can be assembled upon one surface of the tool or jig, for example, upon the lower surface portion thereof, in order to perform a particular cutting and trimming operation with respect to one side edge of a stair tread member, or with respect to one end of a stair tread side edge plank member, and then in order to perform a corresponding cutting and trimming operation with respect to the other side edge of the stair tread member, or with respect to the other end of the stair tread side edge plank member, the clamping mechanisms could effectively be disassembled or dismounted from the lower surface portion of the tool or jib and reassembled or mounted upon the upper surface portion of the tool or jig. This procedure, however, would be quite time-consuming and tedious for operator personnel which, again, would be inefficient and not cost-effective from a manufacturing point of view. It is lastly noted that the conventional, PRIOR ART tool or jig 110 does not have its locating pins and clamping mechanisms arranged so as to in fact be capable of accommodating stair riser members.

A need therefore exists in the art for a new and improved tool or jig which is specifically structured so as to be capable of cutting or trimming both oppositely disposed sides, or both oppositely disposed ends, of the stair tread and stair tread side edge plank members, as well as stair tread riser members, so as to in fact enable both oppositely disposed exposed sides of the stair tread and stair tread side edge members, as well as the riser members, to be appropriately cut, trimmed, and finished in the desired aesthetically pleasing, seamless manner.

SUMMARY OF THE INVENTION

The foregoing and other objectives are achieved in accordance with the teachings and principles of the present invention through the provision of a new and improved single tool or jig which is universally useable in connection with the fabrication or trimming of left and right side edge portions of stair tread members, left and right end portions of stair tread side edge plank members, and stair riser members, so as to permit all of such members or components to be properly mated together in order to impart to the exposed or open staircase assembly members a seamless finished appearance. In particular, the single tool or jig is provided with a pair of oppositely disposed, mirror-image slots wherein each slot has a substantially "hockey-stick" configuration. In addition, a plurality of clamping mechanisms are disposed adjacent to, and upon opposite sides of each one of the slots, so as to be uniquely capable of accommodating, positioning, and securing the stair tread members, the stair tread side edge plank members, and the stair riser members, such that either the left or right side of the stair tread member, or either the left or right end of the stair tread side edge plank member, or an end portion of the riser member, can be appropriately cut and trimmed so as to provide the stair tread, stair tread side edge plank, and riser members with aesthetically finished seamless appearances. More particularly, the clamping mechanisms are removably and adjustably mounted upon the lower or undersurface portion of the support plate or work table, and the number of positions at which the clamping mechanisms can be secured to the lower or undersurface portion of the support plate or work table is greater than the number of clamping mechanisms employed. In this manner, the clamping mechanisms may be dismounted from first predetermined positions upon the support plate or work table and remounted at second predetermined positions upon the support plate or work table so as to effectively alter the pattern or arrangement of the clamping mechanisms upon the support plate or work table in order to be utilized in conjunction with the clamping thereon of a particular stair tread, stair tread side edge plank, or stair riser member.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
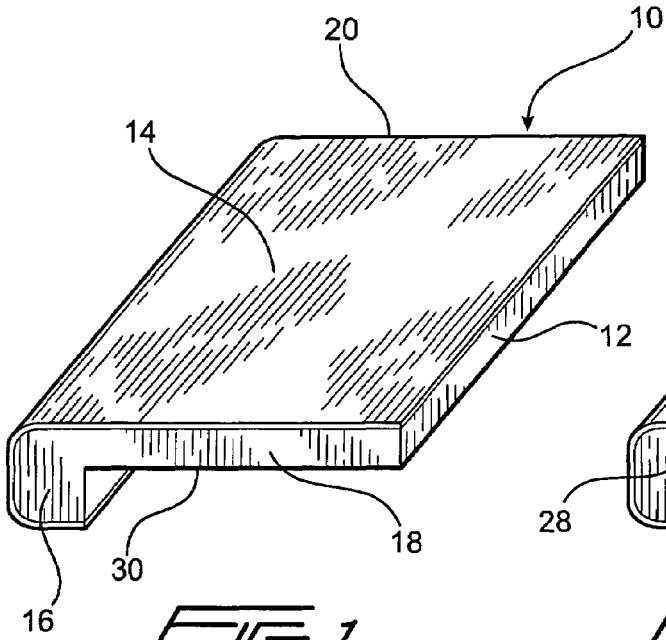
FIG. 1 (PRIOR ART)
FIG. 1 is a perspective view of a conventional, PRIOR ART stair tread member.
Figure 2:
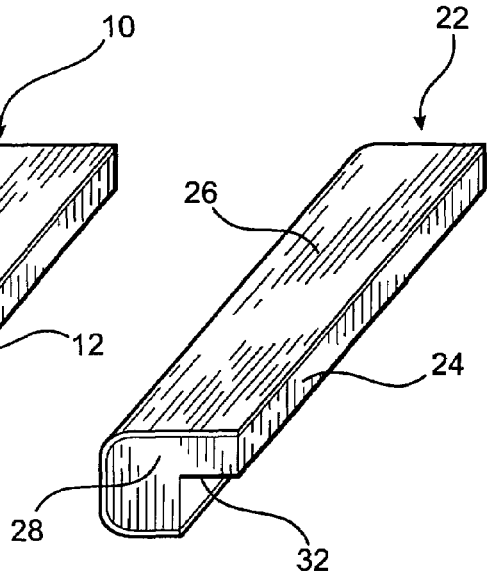
FIG. 2 (PRIOR ART)
FIG. 2 is a perspective view of a conventional, PRIOR ART stair tread side edge plank member which is adapted to be mated in an aesthetic, seamless manner with one unfinished and exposed side of the conventional, PRIOR ART stair tread member disclosed within FIG. 1.
Figure 3:
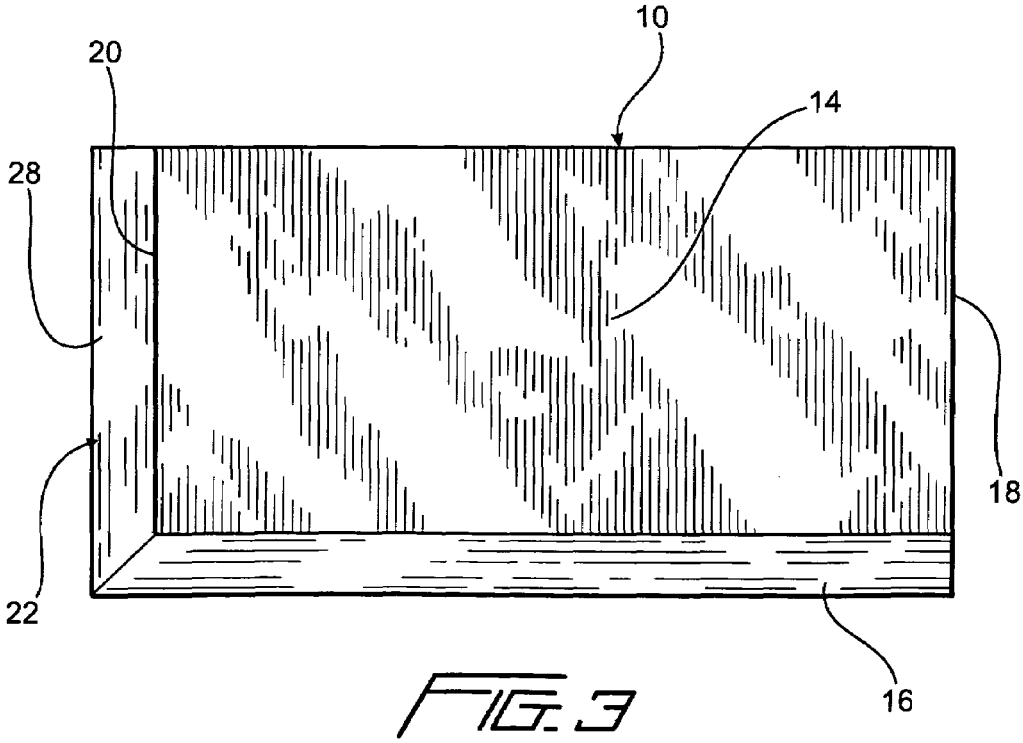
FIG. 3 (PRIOR ART)
FIG. 3 is a to plan view of the conventional, PRIOR ART stair tread member, as illustrated within FIG. 1, mated along its side edge portion with the stair tread side edge plank member, as illustrated within FIG. 2, so as to form a seamlessly finished stair tread assembly along one side edge portion of the stair tread member.

Referring now to the drawings, and more particularly to FIGS. 5-10 thereof, a new and improved tool or jig, which is universally useable in connection with the fabrication or trimming of left and right side edge portions of stair tread members, left and right end portions of stair tread side edge plank members, and stair riser members, so as to permit all of such members or components to be properly mated together in order to impart to the exposed or open staircase assembly members a seamless finished appearance, is disclosed and is generally indicated by the reference character 210. More particularly, it is seen that the new and improved universal tool or jig 210 comprises a support plate or work table 212 which has an upper surface portion 214, as can best be seen in FIGS. 5 and 7, and a lower surface portion 216 which can best be seen in FIGS. 6 and 8-10. The upper surface portion 214 of the support plate or work table 212 is substantially planar and is therefore adapted to have mounted thereon a suitable finishing tool, such as, for example, a router, not shown, while the lower surface portion 216 of the support plate or work table 212 is also substantially planar but, in accordance with a first unique and novel feature that is characteristic of the present invention, has a plurality of clamping mechanisms mounted thereon. More particularly, as viewed within FIG. 6, it is seen that the plurality of clamping mechanisms comprise a first pair of laterally spaced clamping mechanisms 218,220 disposed upon the lower left corner region of the support plate or work table 212, a second pair of laterally spaced clamping mechanisms 222,224 disposed upon the upper left corner region of the support plate or work table 212, a third pair of laterally spaced clamping mechanisms 226,228 disposed upon the upper right corner region of the support plate or work table 212, and a fourth pair of laterally spaced clamping mechanisms 230,232 disposed upon the lower right corner region of the support plate or work table 212. In addition, a fifth pair of clamping mechanisms 234,236 are disposed adjacent to each other and in a back-to-back mode with respect to each other upon the lower central region of the support plate or work table 212, a sixth pair of clamping mechanisms 238, 240 are disposed adjacent to each other and in a back-to-back mode with respect to each other upon the central region of the support plate or work table 212, and a seventh pair of clamping mechanisms 242,244 are disposed adjacent to each other and in a back-to-back mode with respect to each other upon the upper central region of the support plate or work table 212. All of the clamping mechanisms are preferably of the type disclosed within co-pending U.S. patent application entitled METHOD OF CALIBRATING A CLAMPING MECHANISM SO AS TO ACHIEVE A PREDETERMINED, PRECISELY REPEATABLE CLAMPING FORCE, which was filed on Apr. 18, 2005, and which has been assigned Ser. No. 11/107,755, although other similar types of clamping mechanisms may of course be utilized.

With reference continuing to be made to FIGS. 5-10, it is further appreciated that in accordance with a second unique and novel feature characteristic of the present invention, a pair of laterally spaced, longitudinally extending through-slots 246,248 are defined within the support plate or work table 212 so as to extend therethrough from the upper surface portion 214 thereof to the lower surface portion 216 thereof. Each one of the through-slots 246,248 respectively has a substantially "hockey-stick" configuration comprising a primary longitudinally extending straight section 250,252, and a secondary angled section 254,256, and it is noted that the two through-slots 246,248 are effectively mirror images of each other. It is additionally noted that while each secondary angled section 254,256 is preferably disposed at an angle of, for example, 45° with respect to its respective primary straight section 250,252, each angled section 254,256 may be disposed at other predetermined angles with respect to its respective straight section 250,252.

It is further noted that the first clamping mechanisms 218, 220, the second pair of clamping mechanisms 222,224, the third pair of clamping mechanisms 226,228, and the fourth pair of clamping mechanisms 230,232 are all adjustably mounted upon the lower surface portion 216 of the support plate or work table 212 so as to be linearly movable in directions parallel to the longitudinal extents of the straight sections 250,252 of the through-slots 246,248, while the fifth pair of clamping mechanisms 234,236, the sixth pair of clamping mechanisms 238,240, and the seventh pair of clamping mechanisms 242,244 are adjustably mounted upon the lower surface portion 216 of the support plate or work table 212 so as to be linearly movable in directions transverse or perpendicular to the longitudinal extents of the straight sections 250,252 of the through-slots 246,248. In order to permit such adjustments of the clamping mechanisms 218-244, it is further seen that the support plate or work table 212 is also provided with a plurality of elongated slots, which extend through the support plate or work table 212 from the upper surface portion 214 thereof to the lower surface portion 216 thereof, and with which each one of the clamping mechanisms 218-244 may be associated in both adjustable and removable modes of operation.

Figure 5:
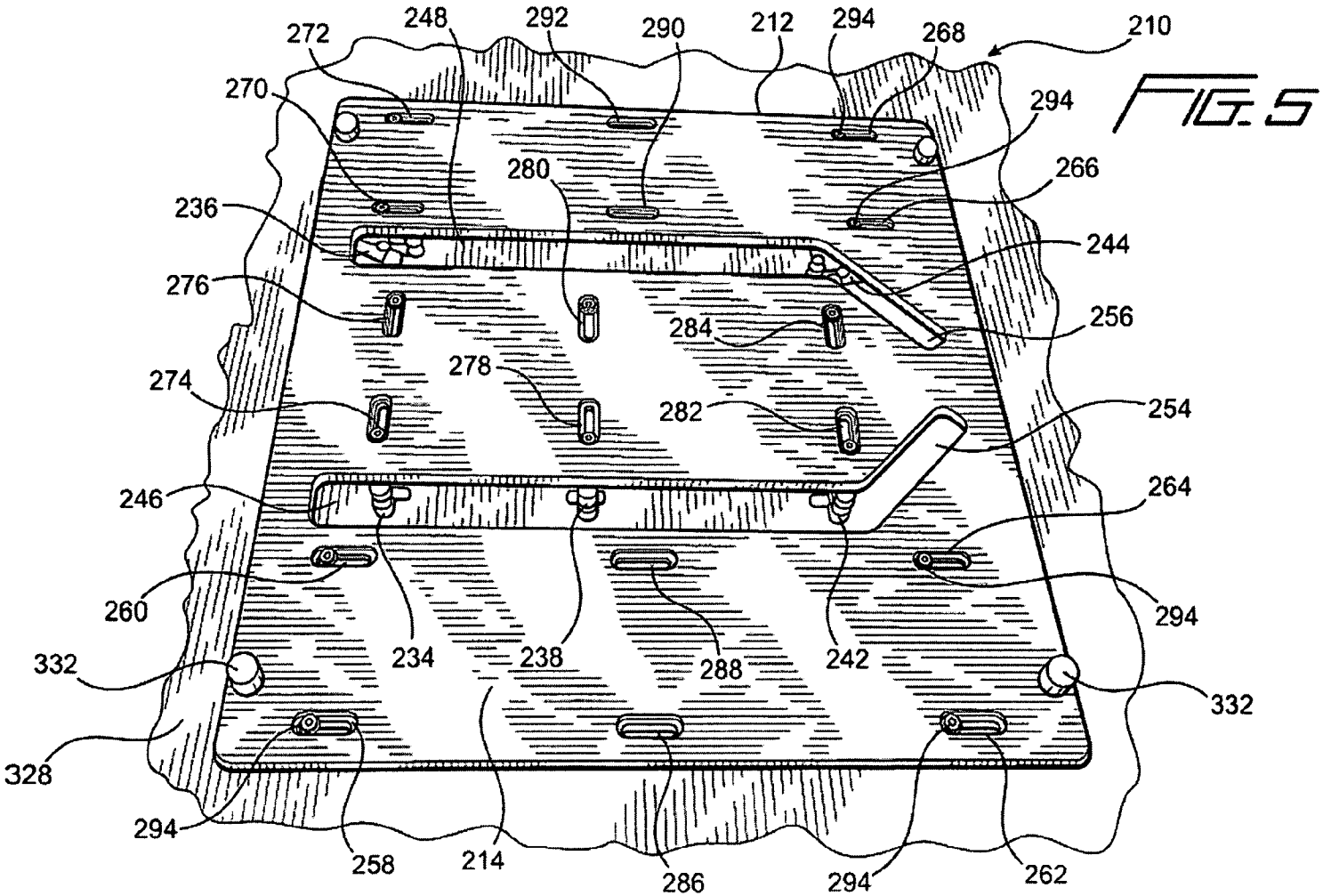
FIG. 5 is a top perspective view of the new and improved universal tool or jig developed in accordance with the principles and teachings of the present invention, and showing the cooperative parts thereof, for facilitating the cutting and trimming of stair tread, stair tread side edge plank, and stair tread riser members in order to enable the stair tread and stair tread side edge plank members to be mated together in a manner which imparts an aesthetic seamless appearance, as well as to properly trim the riser members.
Figure 6:
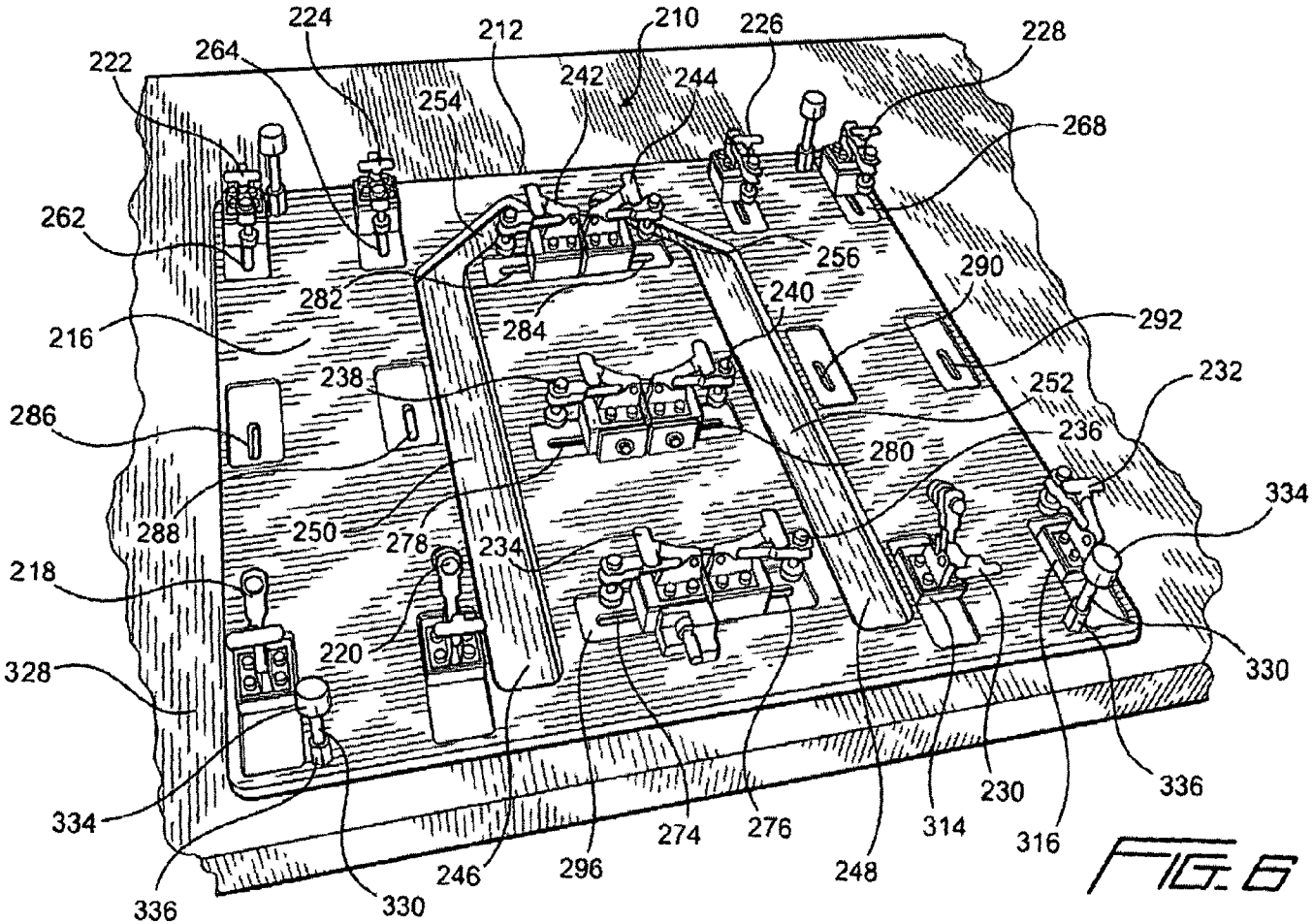
FIG. 6 is a bottom perspective view of the new and improved universal tool or jig of the present invention, and as disclosed within FIG. 5, illustrating the various clamping mechanisms, and their relative dispositions upon the new and improved universal tool or jig, for clamping the stair tread, stair tread side edge plank, and stair tread riser members during the performance of the cutting and trimming operations upon such stair tread, stair tread side edge plank, and stair tread riser members.

More particularly, as can best be appreciated from FIGS. 5 and 6, the first pair of laterally spaced clamping mechanisms 218,220 disposed upon the lower left corner region of the support plate or work table 212 are operatively associated with a first pair of elongated slots 258,260, the second pair of laterally spaced clamping mechanisms 222,224 disposed upon the upper left corner region of the support plate or work table 212 are operatively associated with a second pair of elongated slots 262,264, the third pair of laterally spaced clamping mechanisms 226,228 disposed upon the upper right corner region of the support plate or work table 212 are operatively associated with a third pair of elongated slots 266,268, and the fourth pair of laterally spaced clamping mechanisms 230,232 disposed upon the lower right corner region of the support plate or work table 212 are operatively associated with a fourth pair of elongated slots 270,272. In addition, the fifth pair of clamping mechanisms 234,236 disposed upon the lower central region of the support plate or work table 212 are operatively associated with a fifth pair of elongated slots 274,276, the sixth pair of clamping mechanisms 238,240 disposed upon the central region of the support plate or work table 212 are operatively associated with a sixth pair of elongated slots 278,280, and the seventh pair of clamping mechanisms 242,244 disposed upon the upper central region of the support plate or work table 212 are operatively associated with a seventh pair of elongated slots 282, 284. It is noted still further that the support plate or work table 212 is also provided with an eighth pair of elongated slots 286,288 which are effectively interposed between the first and second pairs of slots 258,260 and 262,264, while a ninth pair of elongated slots 290,292 are effectively interposed between the third and fourth pairs of slots 266,268 and 270,272, for purposes which will become clearer as further operative aspects of the present invention are discussed.

With continued reference being made to FIG. 5, it is further seen that the means for permitting each one of the clamping mechanisms 218-244 to be movably adjusted upon the support plate or work table 212, as well as to be removably mounted and dismounted therefrom, comprises a threaded bolt which is adapted to pass through each one of the respective elongated slots 258-292 so as to be threadedly engaged within the mounting base of each one of the clamping mechanisms 218-244. As can best be seen from FIG. 5, each one of the elongated slots 258-292 is effectively counterbored or countersunk, upon the upper surface portion 214 of the support plate or work table 212, so as to accommodate the head portion 294 of each threaded bolt, and as can best be appreciated from FIG. 6, a slightly countersunk elongated region 296 is defined around each one of the elongated slots 258-292 upon the lower surface portion 216 of the support plate or work table 212. In this manner, when each one of the clamping mechanisms 218-244 is to be movably adjusted with respect to its position upon the lower surface portion 216 of the support plate or work table 212, the countersunk regions 296 will, in effect, guide the clamping mechanisms 218-244 during their respective adjustable movements either in the linear directions parallel to the longitudinal extents of the straight sections 250,252 of the through-slots 246,248, or in the linear directions transverse or perpendicular to the longitudinal extents of the straight sections 250,252 of the of the through-slots 246,248. It is of course to be realized that when any one of the clamping mechanisms 218-244 is to be removed from the support plate or work table 212 so as to, for example, alter the disposition or location of particular ones of the clamping mechanisms 218-244 upon the lower surface portion 216 of the support plate or work table 212, the threaded bolt members are simply removed from the mounting base of the particular one of the clamping mechanisms 218-244, the particular one of the clamping mechanisms 218-244 is repositioned at its new location, and the threaded bolt is again engaged within the mounting base of the particular one of the clamping mechanisms 218-244 so as to tightly secure the particular one of the clamping mechanisms 218-244 upon the lower surface portion of the support plate or work table 212.

Figure 7:
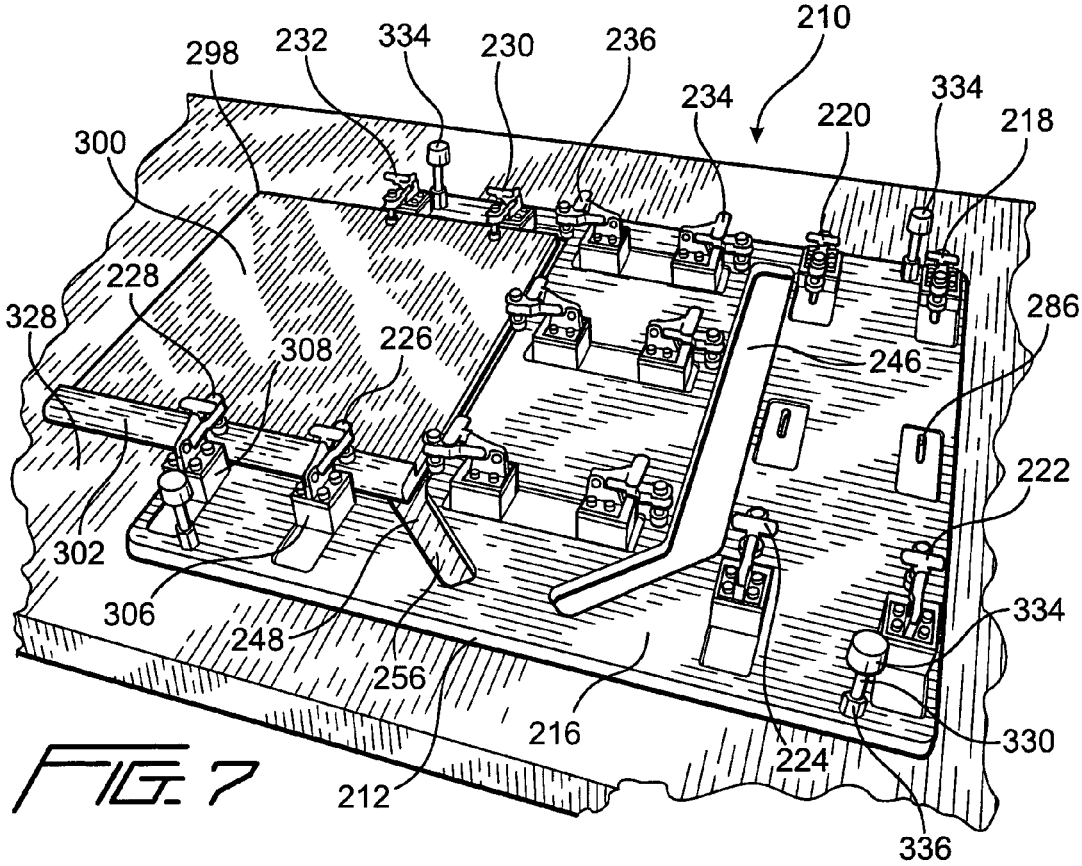
FIG. 7 is a top perspective view of the new and improved universal tool or jig, similar to that of FIG. 6, showing, however, a first arrangement of particular ones of the clamping mechanisms when the same are utilized to clamp a stair tread member upon the upper surface support plate or work table portion of the tool or jig.
Figure 9:
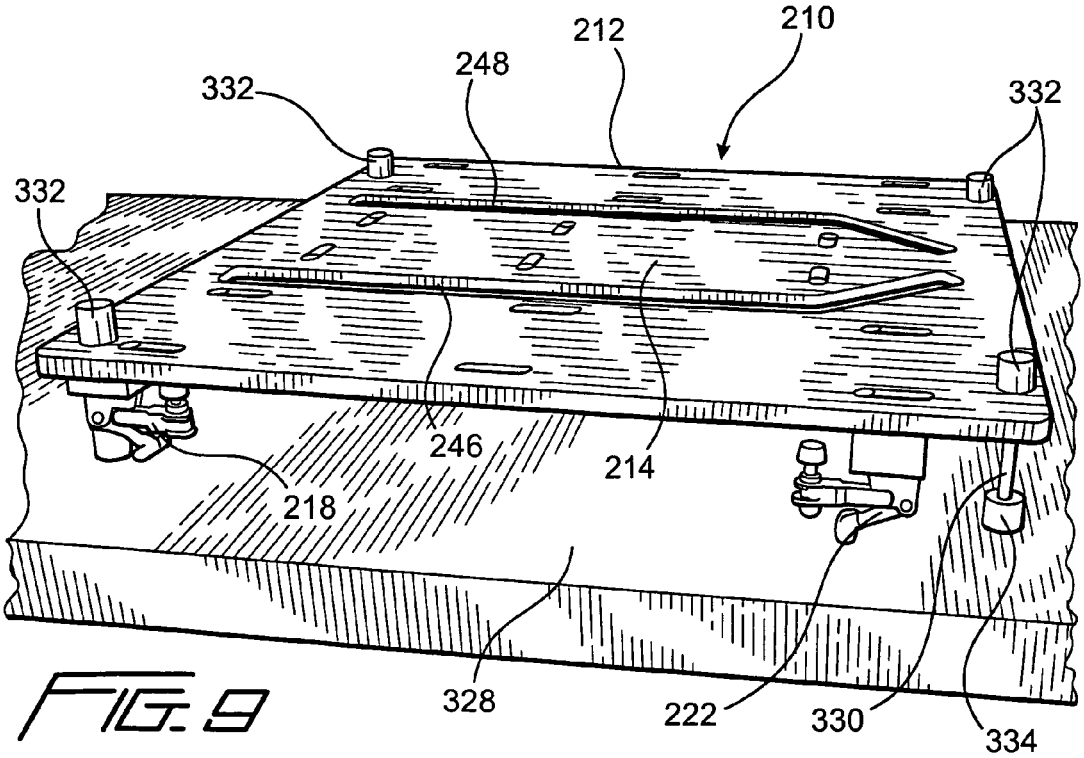
FIG. 9 is a side perspective view of the new and improved universal tool or jig, as disclosed within FIGS. 6 and 7, showing the new and improved universal tool or jig being supported upon a work bench, with the upper surface portion thereof facing, in such a manner that the clamping mechanisms disposed upon the lower surface portion thereof, as disclosed within FIG. 6, do not encounter the work bench.
Figure 8:
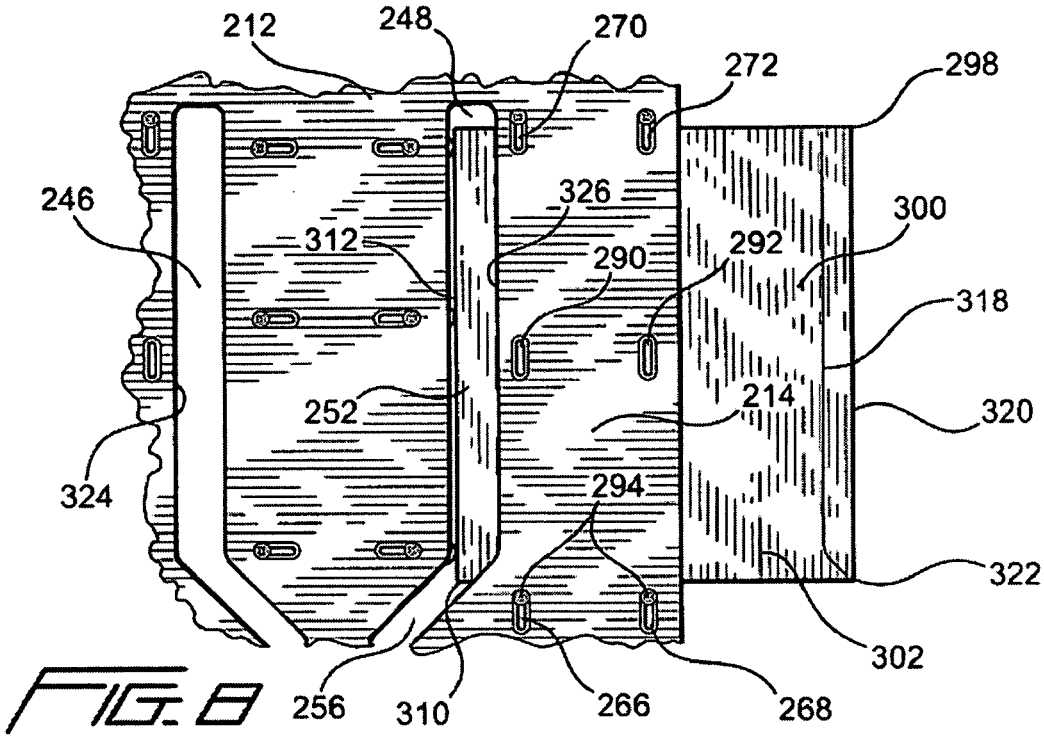
FIG. 8 is a partial, top plan view of the new and improved universal tool or jig, as disclosed within FIG. 5, showing, however, the stair tread member clamped upon the lower surface portion of the tool or jig, as disclosed within FIG. 7, wherein the particular positioning of a corner region of the stair tread member relative to the "hockey stick" slot is disclosed.
Figure 10:
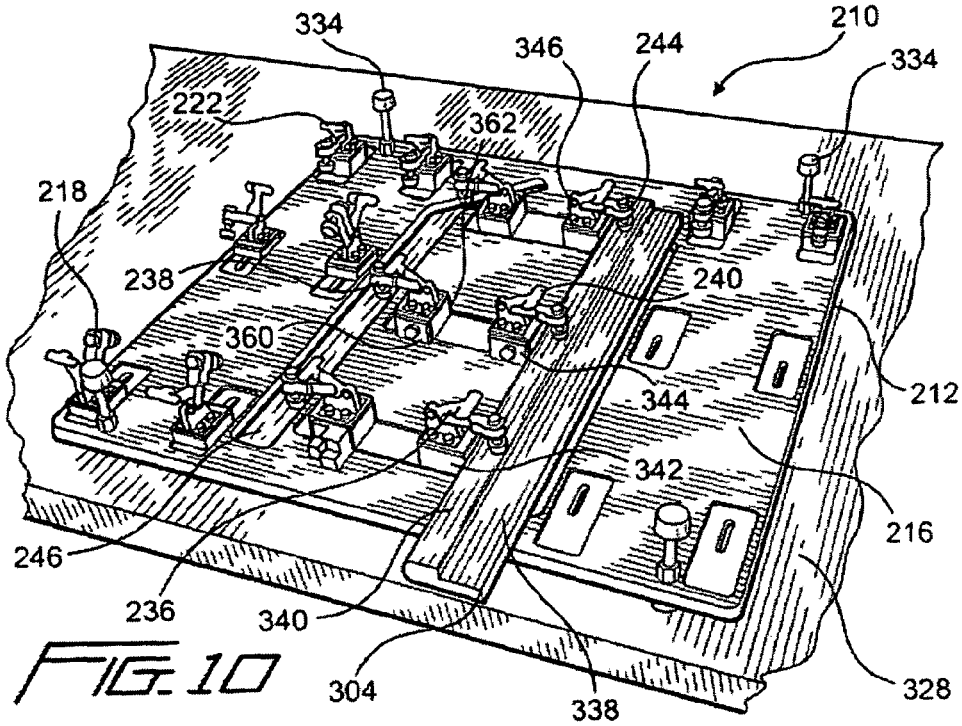
FIG. 10 is a top perspective view of the new and improved universal tool or jig, similar to that of FIGS. 6 and 8, showing, however, a second arrangement of particular ones of the clamping mechanisms when the same are utilized to clamp a stair tread side edge plank member upon the upper surface support plate or work table portion of the tool or jig.

Having described substantially all of the major operative components of the new and improved tool or jig 210, the universal use of the new and improved tool or jig 210, in connection with the fabrication of stair tread, stair tread side edge plank, and riser members of a staircase assembly, will now be described. With reference being made to FIGS. 7 and 8, the use of the new and improved tool or jig 210 in connection with the fabrication of a stair tread assembly 298 will be described first. The stair tread assembly 298 is seen to comprise a stair tread member 300 and a stair tread nose portion 302, and the depth or size of, for example, the mitered interface, along which the stair tread assembly 298 is to be mated with a stair tread side edge plank assembly 304, as disclosed within FIG. 10, is initially determined. As an example, the interface can be determined to either be one inch (1.00") or two inches (2.00"), although any other predetermined dimensions can of course be implemented into the system. It will also be recalled that each one of the clamping mechanisms

218-244 is disposed upon a mounting base which is adjustably positioned upon the lower surface portion 216 of the support plate or work table 212 through means of the elongated slots 258-292 and the threaded bolts passing therethrough. Each one of the slots 258-292 is one inch (1.00") long, and therefore, when the threaded bolts, as illustrated by means of their head portions 294, are disposed at their illustrated positions within FIGS. 5 and 8 in connection with elongated slots 266,268, which correspond to the locations at which the clamping mechanisms 226,228 are mounted, through means of their mounting bases 306,308, upon the support plate or work table 212 as disclosed within FIG. 7, then the mounting bases 306,308 of the clamping mechanisms 226,228 will be preset so as to provide the stair tread assembly 298 with a one inch (1.00") interface, whereas, conversely, if the threaded bolts operatively associated with the mounting bases 306,308 of the clamping mechanisms 226, 228, and as illustrated by means of their head portions 294, were disposed at their opposite positions within their respective elongated slots 266,268, then the mounting bases 306,308 of the clamping mechanisms 226,228 would be preset so as to provide the stair tread assembly 298 with a two inch (2.00") interface.

Having predeterminedly preset the disposition of the mounting bases 306,308 of the clamping mechanisms 226, 228 upon the support plate or work table 212 at their designated positions, the mounting bases 306,308 of the clamping mechanisms 226,228 effectively serve as a fixed datum point against which the nose portion 302 of the stair tread assembly 298 is disposed in firm contact. It is also noted that when the stair tread assembly 298 is positioned upon the support plate or work table 212 such that the nose portion 302 of the stair tread assembly 298 is disposed against the mounting bases 306,308 of the clamping mechanisms 226,228, the stair tread assembly 298 is moved transversely or laterally such that the left front corner region 310 of the nose portion 302 of the stair tread assembly 298 will be visible within the angled slot portion 256 of the "hockey stick" slot 248 as can best be appreciated from FIG. 8. In this manner, when the mitered corner interface is to be formed within the corner region 310 of the nose portion 302 of the stair tread assembly 298, a true corner region is able to be formed upon the stair tread assembly 298 so as to in fact extend from the forward edge of the stair tread assembly 298, as defined by the tangent plane of the nose portion 302, as opposed to undesirably extending from, for example, the exposed side edge portion 312 of the stair tread assembly 298 which would be the case if the corner region 310 of the nose portion 302 of the stair tread assembly 298 was positioned beneath the support plate or work table 212 so as not to be visible within the angled slot portion 256 of the "hockey stick" slot 248.

Once the stair tread assembly 298 is positioned as has just been noted, the clamping mechanisms 226,228,230, and 232 are moved to their CLAMPED and LOCKED positions so as to tightly clamp the stair tread assembly 298 upon the lower surface portion 216 of the support plate or work table 212. It is noted that the distance defined between the mounting bases 306,308 of the clamping mechanisms 226,228, and the mounting bases 314,316 of the clamping mechanisms 230, 232, which can best be seen in FIG. 6, is just slightly larger than the distance defined between the nose portion 302 of the stair tread assembly 298 and the opposite edge portion of the stair tread assembly. In addition, as more specifically noted in copending U.S. patent application entitled METHOD OF CALIBRATING A CLAMPING MECHANISM SO AS TO ACHIEVE A PREDETERMINED, PRECISELY REPEATABLE CLAMPING FORCE, which was filed on Apr. 18, 2005, and which has been assigned Ser. No. 11/107,755, each one of the clamping mechanisms 218-244 is structured so as to be capable of extending vertically upwardly when they are disposed in their fully OPEN positions. These combined features enable the stair tread assembly 298 to be easily deposited upon the lower surface portion 216 of the support plate or work table 212 in accordance with a vertically downward movement between the clamping mechanisms 226,228,230, 232 as opposed to being inserted, for example, in a sideways manner beneath overhanging clamping mechanisms.

It is lastly noted, as can be appreciated from FIGS. 6 and 7 that the thickness or height dimension of each one of the mounting bases 306,308, which respectively mount the clamping mechanisms 226,228 that are clampingly engaged with the nose portion 302 of the stair tread assembly 298, is greater than the thickness or height dimension of each one of the mounting bases 314,316 which respectively mount clamping mechanisms 230,232 that are clampingly engaged with the stair tread portion 300 of the stair tread assembly 298. The reason for this is that the thickness of the nose portion 302 of the stair tread assembly 298 is greater than the thickness of the stair tread member 300 of the stair tread assembly 298. Accordingly, the mounting bases 306,308,314,316 effectively serve to positionally adjust the disposition of the clamping mechanisms 226,228,230,232 in a macro-adjustment manner with respect to the nose portion 302 and stair tread member 300 of the stair tread assembly 298, while the vertical adjustments per se, characteristic of the clamping mechanisms 226,228, 230,232, as is also more particularly noted within the aforenoted copending U.S. patent application entitled METHOD OF CALIBRATING A CLAMPING MECHANISM SO AS TO ACHIEVE A PREDETERMINED, PRECISELY REPEATABLE CLAMPING FORCE, which was filed on Apr. 18, 2005, and which has been assigned Ser. No. 11/107,755, can serve to achieve adjustment of the clamping mechanisms 226,228,230,232 in a micro-adjustment manner.

Continuing further, once the stair tread assembly 298 has been fixedly clamped upon the lower surface portion 216 of the support plate or work table 212, the support plate or work table 212 is turned over or inverted such that the support plate or work table 212, having the stair tread assembly 298 fixedly clamped thereon, is disposed in the position illustrated within FIG. 8. It is noted that the stair tread assembly 298 already has a line 318 drawn thereon, which parallels the unfinished right side edge portion 320 of the stair tread assembly 298 and is then angled toward the right, front corner region 322 of the stair tread assembly 298 which is disposed opposite the left front corner region 310 of the stair tread assembly 298, as a result of the stair tread assembly 298 having been previously clamped upon the support plate or work table 212 whereupon the line 318 was drawn following the contours of the left edge portion 324 of the "hockey stick" slot 246. Accordingly, when the stair tread assembly 298 is disposed at the position illustrated within FIG. 8, a similar line, not illustrated, will be drawn upon the stair tread assembly 298 in accordance with the contours of the right edge portion 326 of the "hockey stick" slot 248. The distance between the marked corners upon the stair tread assembly 298, within the corner regions 310, 322, will precisely determine the desired finished width dimension of the stair tread assembly 298.

It is lastly noted in connection with the support plate or work table 212, and the clamped support thereon of, for example, the stair tread assembly 298, that the corner regions of the support plate or work table 212 are provided with leg assemblies for supporting the support plate or work table 212 upon a work bench 328 both during the clamping of the stair tread assembly 298 upon the support plate or work table 212, as illustrated within FIG. 7, and during the marking of the stair tread assembly 298, when clamped upon the support plate or work table 212, as illustrated within FIG. 8. In particular, it is seen that the leg assemblies comprise threaded rods 330 which have bumper members 332,334 disposed upon opposite ends thereof, and suitable nut members 336 are threadedly engaged upon the threaded rods 330 so as to effectively lock the threaded rods 330 at longitudinal positions wherein the bumper members 332 will engage the upper surface portion 214 of the support plate or work table 212 as illustrated within FIG. 9. In this manner, the bumper members 332 will space the upper surface portion 214 of the support plate or work table 212 from the upper surface portion of the work bench 328, when the upper surface portion 214 of the support plate or work table 212 is facing the upper surface portion of the work bench 328, such as, for example, when the stair tread assembly 298 is being clamped upon the support plate or work table 212 as illustrated within FIG. 7, a sufficient amount to permit an operator's fingers to be inserted between the upper surface portion 214 of the support plate or work table 212 and the upper surface portion of the work bench 328 so as to facilitate turning over of the tool or jig 210 from its position as illustrated within FIG. 7 to that illustrated within FIG. 8. Similarly, the threaded rods 330 and the bumper members 334 will sufficiently space the lower surface portion 216 of the support plate or work table 212 from the upper surface portion of the work bench 328, when the lower surface portion 216 of the support plate or work table 212 is facing the upper surface portion of the work bench 328, such as, for example, when the stair tread assembly 298 is clamped upon the support plate or work table 212 and is being marked as illustrated within FIG. 8, such that the clamping mechanisms 218-244 will not encounter the upper surface of the work bench 328.

Figure 11:
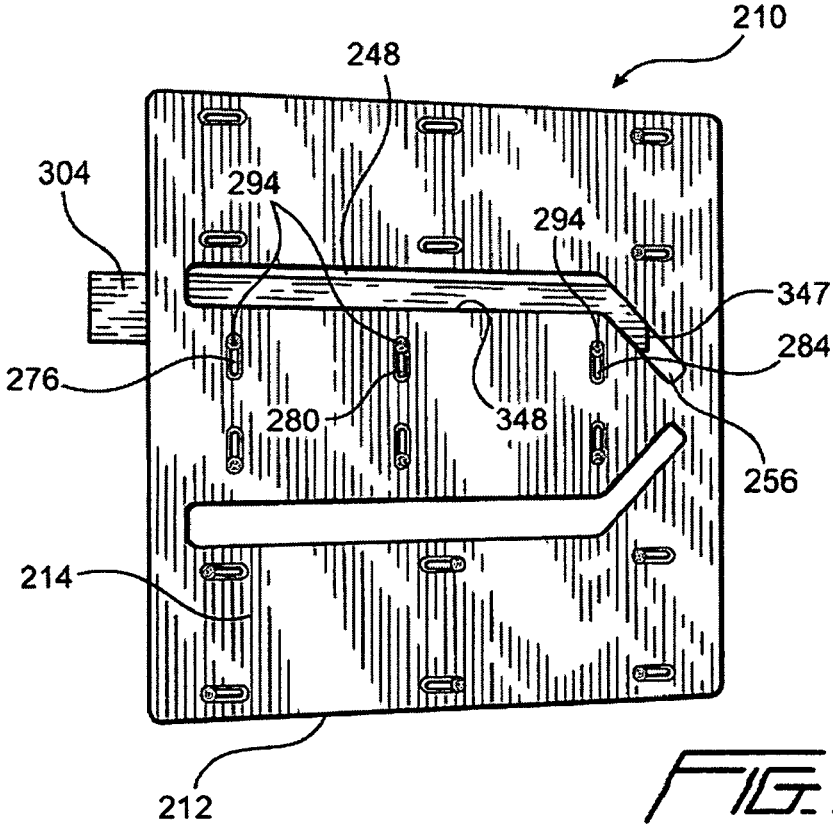
FIG. 11 is a top plan view of the new and improved universal tool or jig, as disclosed within FIG. 5, showing, however, the stair tread side edge plank member clamped upon the lower surface portion of the tool or jig, as disclosed within FIG. 10, wherein the particular positioning of a corner region of the stair tread side edge plank member relative to the "hockey stick" slot is disclosed.

With reference now being made to FIGS. 10 and 11, it is seen that when the stair tread side edge plank assembly 304, comprising a stair tread side edge plank member 338 and a stair tread side edge plank nose portion 340, is to be processed, the stair tread side edge plank assembly 304 is initially clamped upon the lower surface portion 216 of the support plate or work table 212 by means of clamping mechanisms 236,240,244. As was the case with the clamping mechanisms 226,228 which were used to clamp the stair tread nose portion 302 of the stair tread assembly 298, as illustrated within FIGS. 7 and 8, the base members 342,344,346 of the clamping mechanisms 236,240,244 have all been movably adjusted to their one inch (1.00") positions as can readily be appreciated from the dispositions of their threaded bolts, as indicated by means of the threaded bolt head members 294, as disposed within elongated slots 276,280,284 as illustrated within FIG. 11.

This positional adjustment so as to achieve the desired positional disposition of the stair tread side edge plank assembly 304 with respect to the "hockey stick" slot 248 is necessary such that when the stair tread side edge plank assembly 304 is provided with, for example, its mitered cut, the size of the mitered interface defined upon the stair tread side edge plank assembly 304 will in fact precisely match the size of the mitered interface defined upon the stair tread assembly 298. It is likewise noted that the stair tread side edge plank assembly 304 is also longitudinally along the "hockey stick" slot 248 until the corner region 347 is visible within the angled portion 256 of the "hockey stick" slot 248 for the same reasons as previously discussed in connection with the corner region 310 of the stair tread assembly 298 as illustrated within FIG. 8. Once the stair tread side edge plank assembly 304 has been properly clamped upon the support plate or work table 212, as illustrated in FIG. 10, the support plate or work table 212 is inverted to the position illustrated within FIG. 11 and the stair tread side edge plank assembly 304 is marked along the edge portion 348 of the "hockey stick" slot 248 in a manner similar to the marking of the stair tread assembly 298 as illustrated within FIG. 8. As was also the case with the stair tread assembly 298, the stair tread side edge plank assembly 304 will be additionally marked at its opposite end in connection with "hockey stick" slot 246.

After each one of the stair tread and stair tread side edge plank assemblies 298,304 has been clamped and marked as has been previously described, the stair tread and stair tread side edge plank assemblies 298,304 is individually removed from its clamped position upon the support plate or work table 212 and rough cut by means of any suitable, conventional cutting device, such as, for example, a table saw, a jig saw, or the like, not shown. The cuts are made by the cutting devices just slightly outside of the lines marked upon the stair tread and stair tread side edge plank assemblies 298,304 so as to remove excessive material from the stair tread and stair tread side edge plank assemblies 298, 304, and subsequently, the rough cut stair tread and stair tread side edge plank assemblies 298,304 are replaced upon the lower surface portion 216 of the support plate or work table 212 so as to be simultaneously clamped at their respective positions upon the support plate or work table 212 as illustrated within FIGS. 7,8, and FIGS. 10,11. It is to be noted that when the stair tread and stair tread side edge plank assemblies 298,304 are repositioned upon the support plate or work table 212, they are in fact disposed at positions at which the previously marked lines are located precisely at, and aligned with, the edge portions 326,348 of the "hockey stick" slot 248. Subsequently, the support plate or work table 212 is again inverted, and a router mechanism, not shown, is supported upon the upper surface portion 214 of the support plate or work stable 212 while being moved along the edge contours 326,348 of the "hockey stick" slot 248 in order to trim the stair tread and-stair tread side edge plank assemblies 298,304 to their final finished states.

Figure 12:
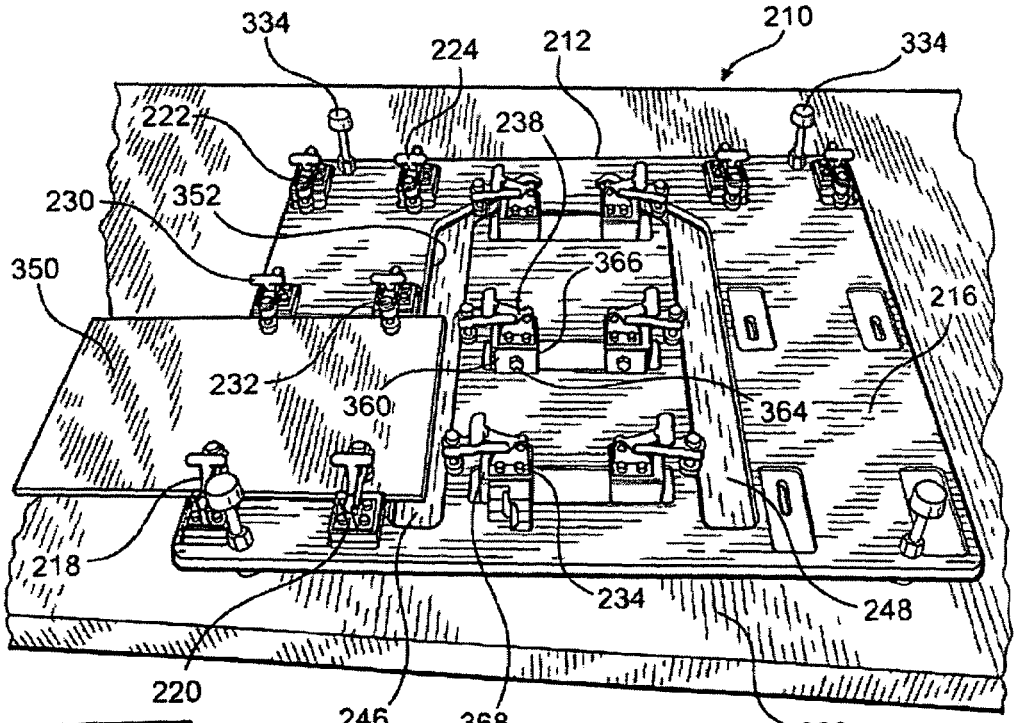
FIG. 12 is a top perspective view of the new and improved universal tool or jig, similar to that of FIGS. 6, 8, and 9, showing, however, a third arrangement of particular ones of the clamping mechanisms when the same are utilized to clamp a stair riser member upon the upper surface support plate or work table portion of the tool or jig.

With reference now being made to FIG. 12, a stair riser member 350 is disclosed as being clamped upon the lower surface portion 216 of the support plate or work table 212, however, it is to be particularly noted that the arrangement of the clamping mechanisms 218-244 utilized in connection with the clamping and cutting of the stair riser member 350 is different from the previous arrangements of the clamping mechanisms 218-244 when utilized for clamping the stair tread assembly 298 or the stair tread side edge plank assembly 304. More particularly, if, for example, the clamping mechanism arrangement as disclosed within FIG. 12 is compared with the clamping mechanism arrangement as disclosed within FIG. 6, it is seen that clamping mechanisms 230,232 have effectively been removed from their positions illustrated within FIG. 6 and have effectively been relocated so as to be fixedly secured within the elongated slots 286,288, as disclosed within FIG. 6, so as to be located at the positions disclosed within FIG. 12 whereby the clamping mechanisms 230, 232 can cooperate with the clamping mechanisms 218, 220 so as to clampingly secure the stair riser member 350 upon the lower surface portion of the support plate or work table 212. Accordingly, once the stair riser member 350 is clamped upon the lower surface portion 216 of the support plate or work table 212, the support plate or work table 212 is inverted, and the stair riser member 350 is marked along the edge portion 352 of the "hockey stick" slot 248. The opposite end portion of the stair riser member 350 may be processed in a similar manner, it being noted that the stair riser member 350 is to have a predetermined length dimension.

Figure 13:
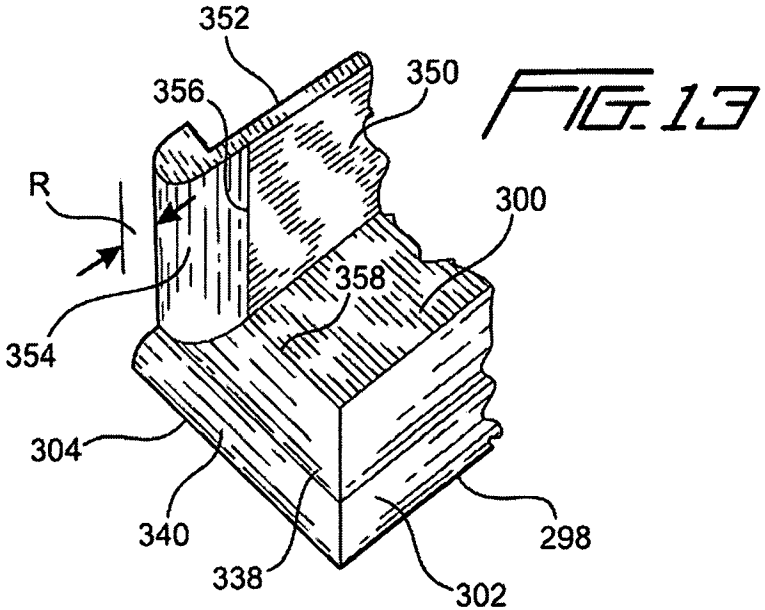
FIG. 13 is a perspective view of a stair riser assembly as disposed atop a stair tread assembly illustrating the setback, offset, or recessed disposition of the end portion of the stair riser assembly with respect to the stair tread assembly so as to achieve an aesthetically desirable finished appearance.

In connection with the fabrication of a stair riser assembly 352, as shown in FIG. 13, wherein the stair riser assembly 352 may comprise, for example, the stair riser member 350 and one or two stair riser nose members 354 to be placed upon the opposite ends of the stair riser member 350, depending upon the particular requirements of a particular staircase structure or assembly, it is to be realized that when the stair riser assembly 352 is disposed atop the stair tread assembly 298, the stair riser nose members 354 are to be disposed in an inwardly offset, setback, or recessed manner with respect to, for example, the nose portion 340 of the stair tread side edge plank assembly 304 by means of a predetermined amount R, which may be, for example, one-quarter inch (0.25"), so as to achieve a pleasing aesthetically finished appearance. Therefore, in accordance with further principles and teachings of the present invention, it is desirable to incorporate, into the new and improved universal stair fabrication tool or jig 210 of the present invention, means for automatically compensating for or accommodating this objective of positioning the nose member 354 of the stair riser assembly 352 in its aforenoted offset, setback, or recessed manner. It is to be noted that the stair riser member 350 cannot simply be made shorter by, for example, one-half inch (0.50") so as to effectively cause each opposite end stair riser nose member 354 to be disposed at its inwardly offset, setback, or recessed position with respect to the stair tread side edge plank nose portion 340 because the seam 356 defined between each one of the stair riser nose members 354 and the respective end portion of the stair riser member 350 would not be visually aligned with the seam 358 defined between one side edge portion of the stair tread member 300 and the stair tread side edge plank member 338.

With reference therefore again being made to FIG. 12, each one of the mounting bases for the clamping mechanisms 218-244 is seen to comprise at least one adjustment plate 360 adjustably mounted upon at least one side of its associated mounting base. In particular, one such adjustment plate 360 is illustrated in conjunction with the mounting base 362 of clamping mechanism 238 which is best seen in FIG. 10. The adjustment plate 360 is secured upon the side of the mounting base 362 by means of a bolt fastener 364 that is threadedly engaged within the mounting base 362, and the adjustment plate 360 is provided with a slot 366, having a length of one-quarter inch (0.25"), which permits the adjustment plate 360 to move relative to mounting base 362 through a stroke of one-quarter inch (0.25"). Accordingly, when the bolt fastener 364 is loosened so as to permit the adjustment plate 360 to be moved toward the left as viewed in FIG. 12, the left edge portion of the adjustment plate 360, which is normally flush with the left end face of the mounting base 362, can project beyond the left end face of the mounting base 362 by means of one-quarter inch (0.25"). The mounting base 368 of the clamping mechanism 234 can be provided with a similar adjustment plate, and therefore, the two adjustment plates can cooperate with each other so as to, in effect, define a fixed datum point, against which the stair riser nose member 354 can be seated in a manner similar to the seating or disposition of the stair-tread side edge plank assembly 304 with respect to the mounting bases 342,344,346 of the clamping mechanisms 236,240,244 as disclosed within FIG. 10, which will be located one-quarter inch (0.25") closer to the "hockey stick" slot 246. Accordingly, the stair riser nose member 354 will, in effect, project one-quarter inch (0.25") further into the "hockey stick" slot 246 such that the residual, marked and cut stair riser member 354 will have a depth dimension of three-quarters of an inch (0.75") so as to permit the stair riser nose member 354 to, in effect, be disposed in the offset, setback, or recessed position with respect to the nose portion 340 of the stair tread side edge plank assembly 304 as illustrated within FIG. 13. It can therefore be appreciated further that despite the fact that the stair riser nose member 354 will, in effect, be disposed in the offset, setback, or recessed position with respect to the nose portion 340 of the stair tread side edge plank assembly 304, the aforenoted seamed portions 356,358 will be perfectly matched for a visually pleasing aesthetically finished appearance.

Figure 14:
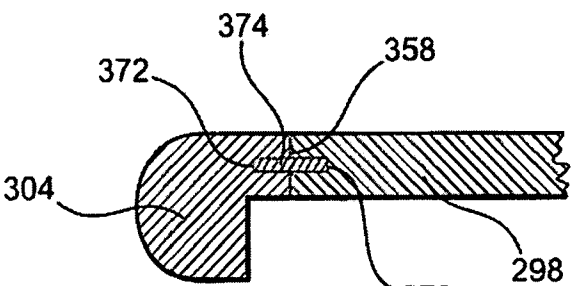
FIG. 14 is a cross-sectional view of a stair tread assembly, and a stair tread side edge plank assembly mated therewith, illustrating a first embodiment technique for maintaining the mated edge portions of the stair tread assembly and the stair tread side edge plank assembly in vertical alignment with respect to each other.
Figure 4:
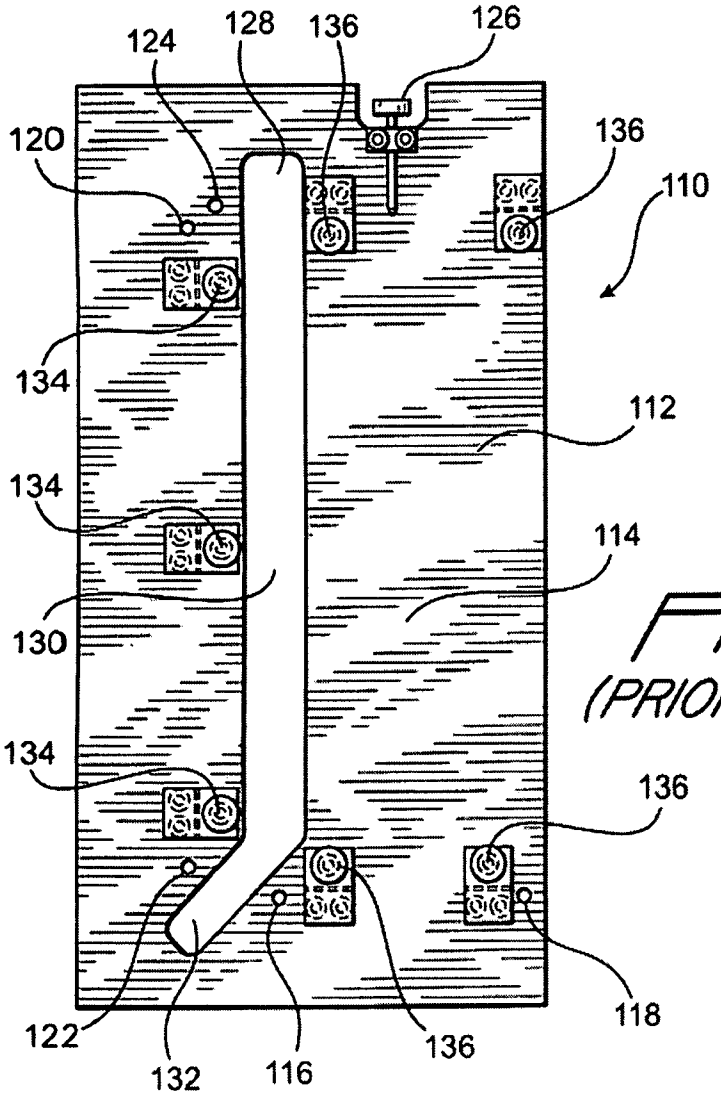
FIG. 4 (PRIOR ART)
FIG. 4 is a bottom plan view of a conventional, PRIOR ART tool or jig for facilitating the cutting and trimming of the conventional, PRIOR ART stair tread and stair tread side edge plank members as disclosed within FIGS. 1 and 2 in order to fabricate the seamlessly finished stair tread assembly as disclosed within FIG. 3.

With reference now being made to FIG. 14, when the finished routed edge portions of the stair tread assembly 298 and the stair tread side edge plank assembly 304 are to be mated, it is sometimes desirable to further ensure, in connection with establishing the surface-to-surface contact defined between the finished routed edge portions of the stair tread assembly 298 and the stair tread side edge plank assembly 304 along the aforenoted seam 358, that the stair tread assembly 298 and the stair tread side edge plank assembly 304 are also properly aligned with respect to each other in the vertical direction, that is, the direction perpendicular to the plane defining their joint connection. Therefore, in accordance with a first technique developed in accordance with the principles and teachings of the present invention, after the aforenoted use of the router to define the finished edge portions of the stair tread assembly 298 and the stair tread side edge plank assembly 304, a router bit comprising, for example, a cutting wheel or the like, not shown, can be used to form a slot 370 within the finished edge portion of the stair tread assembly 298, as well as to form a slot 372 within the finished edge portion of the stair tread side edge plank assembly 304. Subsequently, a key member 374 is inserted into, for example, the slot 370 formed within the finished edge portion of the stair tread assembly 298, and then the slotted portion 372 formed within the stair tread side edge plank assembly 304 is effectively mated with the key member 374 disposed within the side edge portion of the stair tread assembly 298. It can therefore be appreciated that relative vertical movement between the stair tread assembly 298 and the stair tread side edge plank assembly 304 is effectively prevented such that the mated stair tread assembly 298 and stair tread side edge plank assembly 304 will in fact exhibit a proper interface in both horizontal and vertical directions whereby the finished interface in fact exhibits the desired aesthetically finished seamless appearance.

Figure 15:
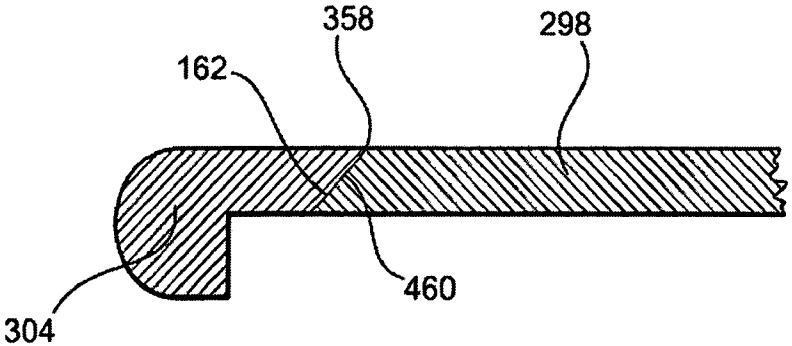
FIG. 15 is a cross-sectional view of a stair tread assembly, and a stair tread side edge plank assembly mated therewith, illustrating a second embodiment technique for maintaining the mated edge portions of the stair tread assembly and the stair tread side edge plank assembly in vertical alignment with respect to each other.
Figure 15B:
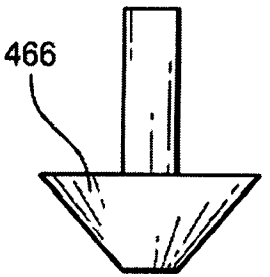
FIG. 15*b* is a cross-sectional view of a router bit that is used to form the edge interface upon the stair tread assembly illustrated within FIG. 15.
Figure 15A:
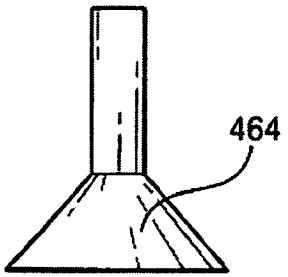
FIG. 15*a* is a cross-sectional view of a router bit that is used to form the edge interface upon the stair tread side edge plank assembly illustrated within FIG. 15.

Continuing further, and with reference being made to FIG. 15, a second technique, developed in accordance with the principles and teachings of the present invention for forming an interengaged interface at the finished edge, seamed location 358 defined between the stair tread assembly 298 and the stair tread side edge plank assembly 304, is disclosed. More particularly, in lieu of the keyed arrangement as disclosed within FIG. 14, complementary inclined beveled surfaces (//), as disclosed at 460,462, are respectively formed upon the mating edge surfaces of the stair tread assembly 298 and the stair tread side edge plank assembly 304. The complementary beveled surfaces 460,462 may be respectively formed by means of suitably configured router bits 464,466 as respectively disclosed within FIGS. 15*a* and 15*b* wherein it can be appreciated that the router bits 464,466 have oppositely disposed, substantially trapezoidal cross-sectional configurations.

It is lastly noted that while the router bit 464 has been used to form the beveled edge surface contour upon the stair tread side edge plank assembly 304, and the router bit 466 has been used to form the beveled edge surface contour upon the stair tread assembly 298, the router bits 464, 466 can of course be used upon the opposite assemblies 298, 304 whereby the slant or incline of the respective beveled surfaces 460,462 defining the seamed interface 358 would simply be disposed in an oppositely inclined manner. As was the case with the keyed arrangement as disclosed within FIG. 14, relative vertical movement between the stair tread assembly 298 and the stair tread side edge plank assembly 304 is effectively prevented such that the mated stair tread assembly 298 and stair tread side edge plank assembly 304 will in fact exhibit a proper interface in both horizontal and vertical directions whereby the finished interface in fact exhibits the desired aesthetically finished seamless appearance.

Figure 16:
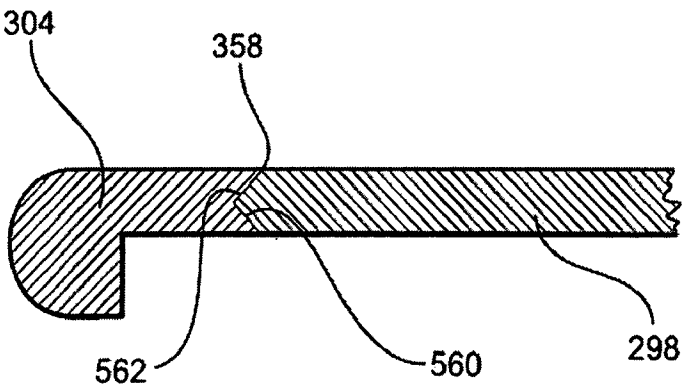
FIG. 16 is a cross-sectional view of a stair tread assembly, and a stair tread side edge plank assembly mated therewith, illustrating a third embodiment technique for maintaining the mated edge portions of the stair tread assembly and the stair tread side edge plank assembly in vertical alignment with respect to each other.
Figure 16B:
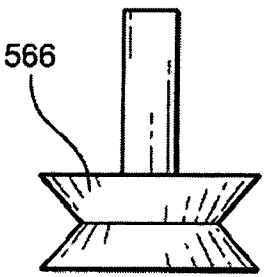
FIG. 16*b* is a cross-sectional view of a router bit that is used to form the edge interface upon the stair tread assembly illustrated within FIG. 16.
Figure 16A:
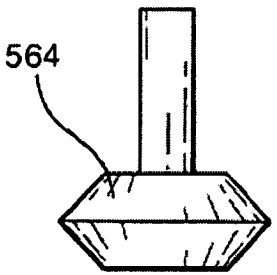
FIG. 16*a* is a cross-sectional view of a router bit that is used to form the edge interface upon the stair tread side edge plank assembly illustrated within FIG. 16.

Lastly, with reference being made to FIG. 16, a third technique, developed in accordance with the principles and teachings of the present invention for forming an interengaged interface at the finished edge, seamed location 358 defined between the stair tread assembly 298 and the stair tread side edge plank assembly 304, is disclosed. It is noted that in lieu of the keyed arrangement as disclosed within FIG. 14, or the beveled surface arrangement as disclosed within FIG. 15, complementary beveled surfaces (<<), as disclosed at 560, 562, are respectively formed upon the mating edge surfaces of the stair tread assembly 298 and the stair tread side edge plank assembly 304. The complementary beveled surfaces 560,562 may be respectively formed by means of suitably configured router bits 564,566 as respectively disclosed within FIGS. 16*a* and 16*b* wherein it can be appreciated that the router bits 564, 566 effectively have oppositely disposed, male and female cross-sectional configurations. It is lastly noted that while the router bit 564 has been used to form the beveled edge surface contour upon the stair tread side edge plank assembly 304, and the router bit 566 has been used to form the beveled edge surface contour upon the stair tread assembly 298, the router bits 564,566 can of course be used upon the opposite assemblies 298,304 whereby the respective male and female beveled surfaces 560,562 defining the seamed interface 358 would simply be disposed upon the opposite stair tread assemblies 298,304. As was the case with the keyed arrangement as disclosed within FIG. 14, or the particular beveled arrangement as disclosed within FIG. 15, relative vertical movement between the stair tread assembly 298 and the stair tread side edge plank assembly 304 is effectively prevented such that the mated stair tread assembly 298 and stair tread side edge plank assembly 304 will in fact exhibit a proper interface in both horizontal and vertical directions whereby the finished interface in fact exhibits the desired aesthetically finished seamless appearance.

Thus, it may be seen that in accordance with the principles and teachings of the present invention, there has been disclosed a new and improved single tool or jig which is universally useable in connection with the fabrication or trimming of left and right side edge portions of stair tread components, left and right end portions of stair tread side edge plank components, and stair riser components, so as to permit all of such components to be properly mated together in order to impart to the exposed or open stair members a seamless finished appearance.

Obviously, many variations and modifications of the present invention are possible in light of the above teachings. For example, while the interface formed along or at the finished edge, seamed location defined between the stair tread assembly and the stair tread side edge plank assembly is disclosed as being linear, other complementary interfaces are of course possible as long as the end result is an aesthetically pleasing, finished, seamless appearance. It is therefore to be understood that within the scope of the appended claims, the present invention may be practiced otherwise than as specifically described herein.

What is claimed as new and desired to be protected by Letters Patent of the United States of America, is:

1. A universal tool for fabricating stair members, comprising:

a work table;

a pair of slot means, each having a substantially hockey-stick configuration, disposed as mirror images with respect to each other, and defined within said work table for defining a profile having a first linear portion and a second angled portion disposed at a predetermined angle with respect to said first linear portion such that when one of the stair tread members, and a corresponding one of the stair tread side edge plank members, are secured upon said work table, a corner portion of the one of the stair tread members, and a corner portion of the corresponding one of the stair tread side edge plank members, can each be provided with a predetermined angled cut portion whereby the angled cut portions of the one of the stair tread members, and of the corresponding one of the stair tread side edge plank members, can together form a mitered joint connection when the one of the stair tread members, and the corresponding one of the stair tread side edge plank members, are joined together; and clamping means mounted upon said work table, at predetermined positions adjacent to said pair of slot means, for adjustably securing the disposition of stair tread and stair tread side edge plank members upon said work table, as well as for accommodating different thickness portions of the stair tread and stair tread side edge plank members, such that said universal tool, comprising said pair of slot means having said substantially hockey stick configurations and disposed as mirror images with respect to each other, can be used to fabricate both left and right side edge portions of stair tread members, and both left and right end portions of stair tread side edge plank members.

2. The tool as set forth in claim 1, wherein:

said clamping means, mounted upon said work table, at said predetermined positions adjacent to said slot means, for securing the stair tread and stair tread side edge plank members upon said work table, comprises a plurality of clamping members.

3. The tool as set forth in claim 2, wherein:

said plurality of clamping members are adjustably mounted upon said work table, with respect to said slot means defined within said work table, so as to enable the stair tread and the stair tread side edge plank members to be cut with different sized profiles.

4. The tool as set forth in claim 2, wherein:

said plurality of clamping members are removably mounted upon said work table so as to accommodate the disposition of the stair tread and stair tread side edge plank members upon said work table.

5. The tool as set forth in claim 4, wherein:

said plurality of clamping members are repositionable upon said work table so as to secure the stair tread and stair tread side edge plank members upon said work table at predetermined locations upon said work table with respect to said slot means defined within said work table.

6. The tool as set forth in claim 5, further comprising:

elongated slot means defined within said work table at predetermined locations within said work table so as to define a predetermined array of said elongated slot means within said work table; and means for removably securing said plurality of clamping members with respect to said elongated slot means defined within said work table such that predetermined ones of said plurality of clamping members may be relocated within predetermined ones of said elongated slot means defined within said work table so as to accommodate the disposition of the stair tread and stair tread side edge plank members upon said work table.

7. The tool as set forth in claim 6, wherein:

said elongated slot means, defined within said work table at predetermined locations within said work table so as to define a predetermined array of said elongated slot means within said work table, comprise counterbored sections; and said means, for removably securing said plurality of clamping members with respect to said elongated slot means defined within said work table such that predetermined ones of said plurality of clamping members may be relocated within predetermined ones of said elongated slot means defined within said work table so as to accommodate the disposition of the stair tread and the stair tread side edge plank members upon said work table, comprise threaded bolts which are to be threadedly engaged with said clamping members and having head portions disposed within said counterbored sections of said elongated slot means.

8. The tool as set forth in claim 1, wherein:

said clamping means are mounted upon said work table, at predetermined positions adjacent to said pair of slot means, for adjustably securing the disposition of stair riser members upon said work table so as to fabricate the stair riser members with predetermined height dimensions.

9. The tool as set forth in claim 8, further comprising:

adjustment plate means adjustably mounted upon said plurality of clamping members for engaging nose portions of the stair riser members so as to provide the stair riser members with sized profiles less than the sized profiles of the stair tread side edge plank members such that the nose portions of the stair riser members will be set back from the stair tread side edge plank members.

10. The tool as set forth in claim 1, wherein:

said clamping means comprises differently sized base members for accommodating the different thickness portions of the stair tread and stair tread side edge plank members.

11. In combination, a plurality of stair members and a universal tool for fabricating the stair members, comprising:

a plurality of stair tread and stair tread side edge plank members;

a work table;

a pair of slot means, each having a substantially hockey-stick configuration, disposed as mirror images with respect to each other, and defined within said work table for defining a profile having a first linear portion and a second angled portion disposed at a predetermined angle with respect to said first linear portion such that when one of said stair tread members, and a corresponding one of said stair tread side edge plank members, are secured upon said work table, a corner portion of said one of said stair tread members, and a corner portion of said corresponding one of said stair tread side edge plank members, can each be provided with a predetermined angled cut portion whereby the angled cut portions of said one of said stair tread members, and of said corresponding one of said stair tread side edge plank members, can together form a mitered joint connection when said one of said stair tread members, and said corresponding one of said stair tread side edge plank members, are joined together; and clamping means mounted upon said work table, at predetermined positions adjacent to said pair of slot means, for adjustably securing the disposition of said stair tread and said stair tread side edge plank members upon said work table, as well as for accommodating different thickness portions of said stair tread and said stair tread side edge plank members, such that said universal tool, comprising said pair of slot means having said substantially hockey stick configurations and disposed as mirror images with respect to each other, can be used to fabricate both left and right side edge portions of said stair tread members and both left and right end portions of said stair tread side edge plank members.

12. The combination as set forth in claim 11, wherein:

said clamping means, mounted upon said work table, at said predetermined positions adjacent to said slot means, for securing said stair tread and said stair tread side edge plank members upon said work table, comprises a plurality of clamping members.

13. The combination as set forth in claim 12, wherein:

said plurality of clamping members are adjustably mounted upon said work table, with respect to said slot means defined within said work table, so as to enable said stair tread and said stair tread side edge plank members to be cut with different sized profiles.

14. The combination as set forth in claim 12, wherein:

said plurality of clamping members are removably mounted upon said work table so as to accommodate the disposition of said stair tread and said stair tread side edge plank members upon said work table.

15. The combination as set forth in claim 14, wherein:

said plurality of clamping members are repositionable upon said work table so as to secure said stair tread and said stair tread side edge plank members upon said work table at predetermined locations upon said work table with respect to said slot means defined within said work table.

16. The combination as set forth in claim 15, further comprising:

elongated slot means defined within said work table at predetermined locations within said work table so as to define a predetermined array of said elongated slot means within said work table; and means for removably securing said plurality of clamping members with respect to said elongated slot means defined within said work table such that predetermined ones of said plurality of clamping members may be relocated within predetermined ones of said elongated slot means defined within said work table so as to accommodate the disposition of said stair tread and said stair tread side edge plank members upon said work table.

17. The combination as set forth in claim 16, wherein:

said elongated slot means, defined within said work table at predetermined locations within said work table so as to define a predetermined array of said elongated slot means within said work table, comprise counterbored sections; and said means, for removably securing said plurality of clamping members with respect to said elongated slot means defined within said work table such that predetermined ones of said plurality of clamping members may be relocated within predetermined ones of said elongated slot means defined within said work table so as to accommodate the disposition of the stair tread and the stair tread side edge plank members upon said work table, comprise threaded bolts which are to be threadedly engaged with said clamping members and having head portions disposed within said counterbored sections of said elongated slot means.

18. The combination as set forth in claim 11 further comprising:

means defined upon said joined together stair tread and stair tread side edge plank members for preventing relative movement of said stair tread and said stair tread side edge plank members with respect to each other in a direction perpendicular to the plane within which their joint connection is defined.

19. The combination as set forth in claim 18, wherein:

said means defined upon said joined together stair tread and stair tread side edge plank members for preventing said relative movement of said stair tread and said stair tread side edge plank members with respect to each other in said direction perpendicular to the plane within which their joint connection is defined is selected from the group comprising a key member and beveled interfaces.

20. The combination as set forth in claim 11, wherein:

said clamping means are mounted upon said work table, at predetermined positions adjacent to said pair of slot means, for adjustably securing the disposition of stair riser members upon said work table so as to fabricate the stair riser members with predetermined height dimensions.

21. The combination as set forth in claim 20, further comprising:

adjustment plate means adjustably mounted upon said plurality of clamping members for engaging nose portions of said stair riser members so as to provide said stair riser members with sized profiles less than the sized profiles of said stair tread side edge plank members such that nose portions of said stair riser members will be set back from said stair tread side edge plank members.

22. The combination as set forth in claim 11, wherein:

said clamping means comprises differently sized base members for accommodating the different thickness portions of the stair tread and stair tread side edge plank members.

* * * * *

UNITED STATES PATENT AND TRADEMARK OFFICE

CERTIFICATE OF CORRECTION

PATENT NO. : 7,661,241 B2
APPLICATION NO. : 11/107760
DATED : February 16, 2010
INVENTOR(S) : Gosis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1024 days.

Signed and Sealed this

Thirtieth Day of November, 2010

David J. Kappos

David J. Kappos
*Director of the United States Patent and Trademark Office*